United States Patent [19]

Knoke

[11] 4,263,683

[45] Apr. 28, 1981

[54] BED FRAME

[75] Inventor: Silas J. Knoke, Seymour, Ind.

[73] Assignee: Lear Siegler, Inc., Santa Monica, Calif.

[21] Appl. No.: 57,236

[22] Filed: Jul. 13, 1979

Related U.S. Application Data

[63] Continuation of Ser. No. 934,307, Aug. 17, 1978, abandoned.

[51] Int. Cl.[3] ..... A47C 19/00

[52] U.S. Cl. ..... 5/200 R; 5/286; 5/310

[58] Field of Search ..... 5/131, 176 R, 185, 200 R, 5/201, 286, 305, 310

[56] References Cited

U.S. PATENT DOCUMENTS

| | | | |
|---|---|---|---|
| 930,340 | 8/1909 | Berry | 5/305 |
| 2,900,647 | 8/1959 | Sands | 5/201 |
| 3,736,602 | 6/1973 | Miller | 5/176 |
| 3,768,106 | 10/1973 | Fritzgerald | 5/131 |
| 4,038,710 | 8/1977 | Tanbascio | 5/201 |

*Primary Examiner*—Casmir A. Nunberg

*Attorney, Agent, or Firm*—Reising, Ethington, Barnard, Perry & Brooks

[57] ABSTRACT

In accordance with the invention there is provided a bed frame which is adjustable in width to king size and which at any width has great strength to the end that it has utility not only for beds with conventional bedding but also for water beds. The bed frame has longitudinal side rails and a longitudinal center rail, transverse end rails and a transverse center rail, the end rails and transverse center rail all being of adjustable length so as to enable adjustment of the bed to different widths and all being substantially coplanar with the longitudinal side rails and center rail, the bed having nine support legs one of which is directly underneath the connection between the transverse and longitudinal center rails and the other eight of which are adjacent the other connections between the transverse and longitudinal rails.

4 Claims, 6 Drawing Figures

BED FRAME

This is a continuation, of application Ser. No. 934,307, filed Aug. 17, 1978 now abandoned.

TECHNICAL FIELD

The subject matter of the present invention is a bed frame which is of adjustable width and which, by way of the structure and arrangement of support rails and legs, is possessed of a very high strength such that the bed frame is useful not only for beds with conventional bedding but also for water beds which are demanding of great strength to support the weight of the water.

BACKGROUND ART

Bed frames which are adjustable in width to king size and which have a longitudinal center rail are well known in the art as exemplified by U.S. Pat. No. 3,736,602. In such bed frames the longitudinal center rail functions to enable the use of two twin-size box springs or foundations positioned side by side on the frame with their inner edges supported by the center rail. It is also old in the bed frame art to provide a transverse center rail to increase the support surface and strength of the frame, U.S. Pat. No. 4,038,710 being illustrative. More generally stated, rectangular bed frames having not only end and side rails but also various configurations of center rails, transverse, longitudinal and diagonal, are old in the art, dating well back into the nineteenth century. Illustrative are U.S. Pat. Nos. 13,034; 930,340; and 1,478,937. To provide added support for bed frames it is also well known to use a greater number of legs than just the conventional four legs at the corners, some of the aforementioned patents being illustrative.

Where center rails which cross each other are used, it is desirable that the crossed rails lie in the same plane. This generally involves the use of a hub into which four rail sections are fitted, i.e. two rail sections to form one of the crossed rails and the other two rail sections to form the other of the crossed rails. But the use of a hub involves added expense, and this is particularly so where the bed frame is to be of adjustable width. That is, for the bed frame to be of adjustable width it is necessary that one of the crossed rails be of adjustable length by way of being formed of two rail members in telescoped relationship, and the best location for the telescoped portions of the rail members is at the center of the rail which, if a hub is used, is precisely where the hub is located.

Hence, whereas the prior art shows the use of longitudinal and transverse center rails and the use of more than just four support legs to provide a bed frame having added strength, and whereas the prior art shows it to be old to provide a bed frame of adjustable width by the use of rails which are of adjustable length by way of having telescoping portions, the prior art provides no solution to the problem of providing a bed frame which is adjustable in width even to king size, which is possessed of ample strength and support both at its periphery and in its center portions so as to be useful even for water beds which require massive strength to support the weight of the water, but yet which can be manufactured at low cost and can also be shipped or transported at low cost by way of being easily disassemblable to fit into a compact package for shipment or transport. The present invention provides such a bed frame.

DISCLOSURE OF THE INVENTION

The bed frame of the present invention has parallel longitudinal side rails, parallel transverse end rails extending between and having their ends pivotally connected to the side rails, a longitudinal center rail between and extending parallel to the side rails and having ends disconnectably connected to the end rails, and a transverse center rail which is parallel to the end rails and which has its ends disconnectably connected to the side rails, all of the longitudinal and transverse rails being in substantially the same plane. The longitudinal center rail has a transverse opening therethrough, through which extends the transverse center rail. Each of the end rails and the transverse center rail comprises two rail members which are in telescoped relationship and which are adjustably connected together at the location of the connection of the transverse rail to the longitudinal center rail. A support leg is secured and extends downwardly from the frame directly underneath the connection between the longitudinal and transverse center rails, and there are eight peripheral support legs, one adjacent each of the other eight connections between the transverse rails and the longitudinal rails. By the provision of the transverse opening in the longitudinal center rail, there is accommodation for the transverse center rail to be in crossed coplanar relationship with the longitudinal center rail as well as accommodation for the adjustable telescoped portions of the transverse center rail to be located at the center of the transverse rail where it connects to the longitudinal center rail. The transverse opening in the longitudinal center rail renders the longitudinal center rail weak at the location of the opening; however, this weakness is rendered innocuous by locating a support leg directly underneath the opening. The transverse and longitudinal center rails are readily disconnectable from the side and end rails and from each other, and the telescoped rail members of each of the transverse rails are also readily disconnectable, the pivotal connections between transverse end rail members and the side rails enabling each of the end rail members to be folded against the side rail to which it is connected. Hence, the entire frame can be compactly packaged when disassembled. The crossed coplanar center rails, with the support leg directly underneath their juncture, impart great strength to the entire central portion of the frame which complements the strong support afforded by the eight peripheral legs. Hence, the frame is well suited not just for household use for a king sized bed, or smaller, but also for commercial heavy-duty use as in hotels and motels. Still further, because of its great strength the frame is excellent for water beds which conventionally require a more costly, specialized support for bearing the heavy load imposed by the weight of the water.

The above and other features and advantages of the invention will appear more clearly from the drawings and the detailed description of the preferred embodiment which follows.

BEST MODE FOR CARRYING OUT THE INVENTION

Figure 1:
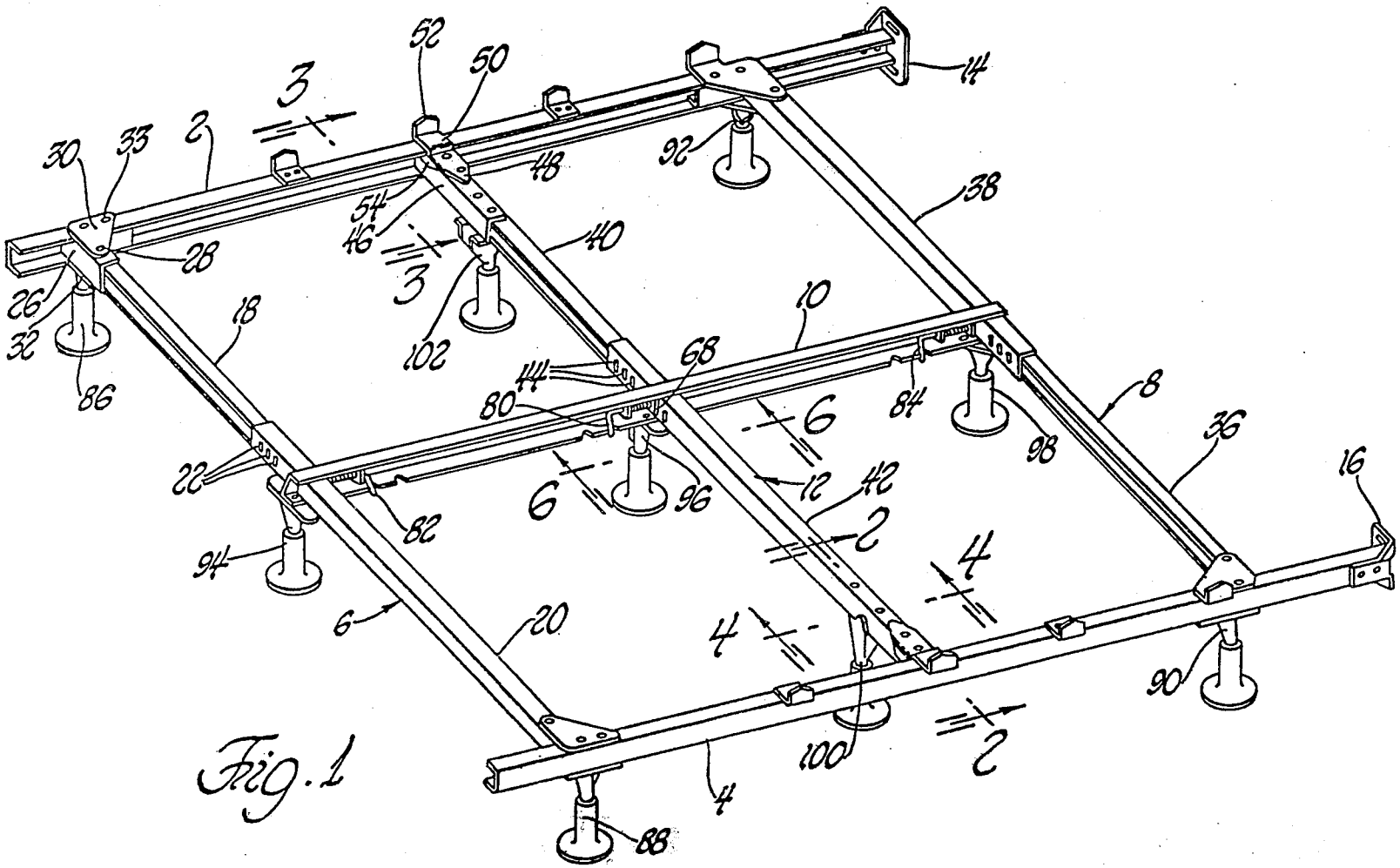
FIG. 1 is a perspective view of a bed frame constructed in accordance with the invention.

Referring now to the drawings, the bed frame shown has two spaced, parallel, longitudinal side rails 2 and 4, two spaced, parallel, transverse end rails 6 and 8, a longitudinal center rail 10 located midway of the side rails, and a transverse center rail 12 located midway of the end rails. In the embodiments shown the side rails extend beyond the end rails and the ends of the side rails at the head end of the frame have brackets 14 and 16 secured thereto for attachment of a bed headboard (not shown) if such should be desired. Of course, it will be understood that such brackets can also be used at the other ends of the side rails, if desired, for attachment of a footboard.

Each of the side rails 2 and 4 is of channel iron, or rectangular C-shape in section, the channel of each of these rails opening to the center or interior of the frame. The longitudinal center rail is of like construction, it being indifferent whether the channel of the longitudinal center rail opens to one side or the other of the frame; in the embodiment shown it opens to the right as viewed from the foot end of the frame.

Transverse end rail 6 comprises two rail members, 18 and 20, each of which is of channel shape, the same as that of the side rails. One of the rail members, member 18, has a cross section sufficiently smaller than that of the other rail member, member 20, to nest snugly within rail member 20 such that it is in telescoped relationship therewith. The channels of two members 18 and 20 face in opposite directions such that at the location of their nested telescoped relationship the combination of the two members is of rectangular box cross section. The oppositely disposed side walls of the rail formed by the two telescoped rail members is each provided with a plurality of holes, as shown at 22, the spacing between the holes in each member being the same as the spacing of the holes in the other member.

Figure 4:
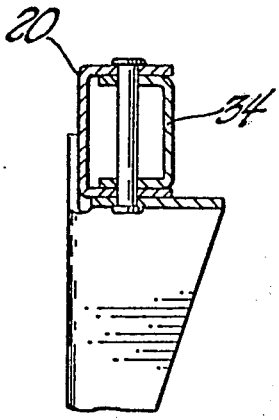
FIG. 4 is a view taken on the line 4—4 of FIG. 1.
Figure 5:
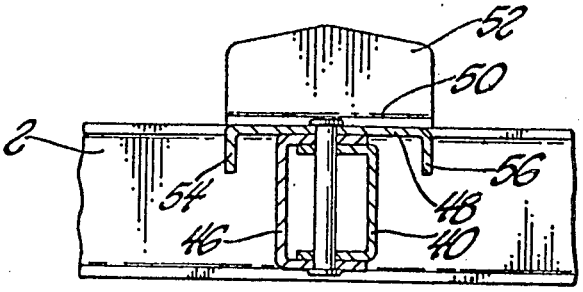
FIG. 5 is a view taken on the line 5—5 of FIG. 3.

The end rail member 18 which connects to the side rail 2 is fitted with a snugly fitting, short, channel-shaped reinforcing member 26 which is secured to the exterior of rail member 18 by rivets or the like. The channel of reinforcing member 26 faces in the opposite direction from that of rail member 18 and hence the combination of the two provides a box section. This reinforced rail end has a vertical opening therethrough which accommodates a pivot pin 28 secured to top and bottom triangular plates 30 and 32 which are secured, as by rivets 33, to the top and bottom, respectively, of the side rail 2. The end of rail member 20 which connects to the side rail 4 is likewise reinforced with a short, channel-shaped member 34 (see FIG. 4), but here the short, channel-shaped member is fitted into and secured to the inside of member 20, the channels facing in opposite directions to provide the desired box section. This reinforced end of rail member 20 is pivoted to side rail 4 in like manner as described relative to rail member 18. Hence, when the frame is disassembled each of the rail members 18 and 20 can, by way of its pivot connection, be folded against the side rail to which it is so connected.

The structure and pivoted connections of end rail 8 are the same as described with reference to end rail 6 except that the positions of the two rail members is reversed. That is, as viewed from the foot of the bed, the rail member 36, which is of smaller cross section, is on the right and the rail member 38, which is of larger cross section, is on the left, which is the reverse of the relative positions of rail members 18 and 20 of end rail 6.

Transverse center rail 12 is of like construction to the end rails in that it has two channel-shaped rail members 40 and 42 which are in nested, telescoped relationship and with spaced holes, such as shown at 44, in the side walls of both rail members at the location of the telescoped relationship, all as described above with reference to end rail 6. The end rail member 40 which connects to side rail 2 is fitted with a channel-shaped reinforcing member 46 secured by rivets to the exterior top and bottom surfaces of rail member 40 with the channels facing in opposite directions to provide the desired box section. The height of this box section is the same as the distance between the interior surfaces of the top and bottom horizontal flanges of the channel-shaped side rail 2 such that this reinforced end of the transverse center rail can fit snugly into the channel of the side rail. Riveted to the top of this reinforced end of rail member 40 is a plate 48 having a raised portion 50 which terminates laterally outwardly of the side rail 2 in an upwardly extending tab 52. The plate 48 also has downwardly extending flanges 54 and 56. The top edges 58 and 60 of the distal ends of these flanges are separated from the raised portion of the plate a distance the same as the thickness of the top horizontal flange of the channel-shaped side rail 2 such that this top horizontal flange fits snugly between the raised portion and the distal ends of the flanges 54 and 56 when the reinforced end of the rail member is mated into the channel of the side rail as shown.

The end of rail member 42 which connects to side rail 4 (see FIG. 2) is of the same construction as the described with reference to rail member 40 except that the reinforcing member, shown at 62, fits into and is secured to the inside of the channel of rail member 42 rather than to the outside as in the case of channel member 40.

Figure 6:
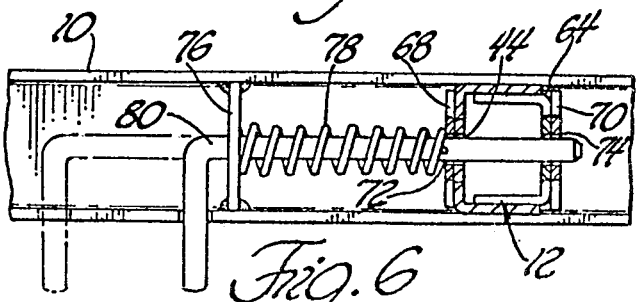
FIG. 6 is a view taken on the line 6—6 of FIG. 1.

The longitudinal center rail 10 has a rectangular opening 64 (see FIG. 6) at the center thereof having dimensions substantially the same as those of the exterior of the telescoped portion of the transverse rail 12 such that this telescoped portion fits snugly in the opening. At the sides of the opening are outstruck tabs 68 and 70 having round openings 72 and 74, respectively, therethrough. These openings are aligned with each other and are aligned with an opening in a transversely extending tab 76 which is secured to the longitudinal center rail in spaced relationship to the tab 68. A cylindrical pin 80 having an L-shaped end portion extends through the opening in tab 76 and the openings 72 and 74 and is spring-biased in the direction of openings 72 and 74 by a coil spring 78, one end of which rests against tab 76 and the other end of which is secured to the pin.

When the frame is in its assembled condition, as shown, the pin 80, under the bias of coil spring 78, extends through the openings 72 and 74 and through a pair of opposed openings 44 in the transverse center rail which are aligned with each other and with the openings 72 and 74. To disassemble the frame the pin 80 is withdrawn from the opening 74 and from the openings 44 in the transverse center rail, to the pin position shown in phantom in FIG. 6, whereupon the telescoped transverse center rail members can be pulled apart from each other and grom the opening 64 in the longitudinal center rail.

The connections of the end rails 6 and 8 with the longitudinal center rail are of the same structure as that of the connection between the transverse and longitudinal center rails, the pin for the connection between the longitudinal center rail and end rail 6 being shown at 82 (see FIG. 1), and the pin for the connection between the longitudinal center rail and end rail 8 being shown at 84.

The bed frame is supported by nine legs, one for each of the nine connections between the longitudinally extending and transversely extending rails. Support legs 86, 88, 90, and 92 are at the corners of the frame and are secured to the side rails under the pivotal connections between the side rails and the end rail members. Support legs 94, 96, and 98 are secured to the longitudinal center rail underneath the rectangular openings in the longitudinal center rail through which extend the end rails and transverse center rail. The other two support legs, legs 100 and 102, are secured to the underside of the transverse center rail adjacent the connections thereof with the side rails.

All nine of the support legs are, of course, important to the high load carrying performance of the bed frame; but most important, in this respect, is support leg 96 and its location directly underneath the connection between the transverse and longitudinal center rails. That is, because of the opening 64 at the middle of the longitudinal center rail (whereby substantial planarity between the transverse and longitudinal center rails is attained), there is substantial weakening of the longitudinal center rail right at the center of the bed frame where strength is most needed; however, this weakening of the longitudinal center rail by way of such opening is rendered innocuous by positioning the support leg 96 directly underneath the opening to the end that the longitudinal center rail cannot, absent failure of the support leg, bend downwardly at that point.

In its disassembled condition, the rail members of the end rails and transverse center rail are separated from each other and the rail members of the end rails can be pivoted, by way of their pivoted connections, to positions folded against the side rails. Hence, the frame can be compactly packaged for storage or shipment.

Figure 2:
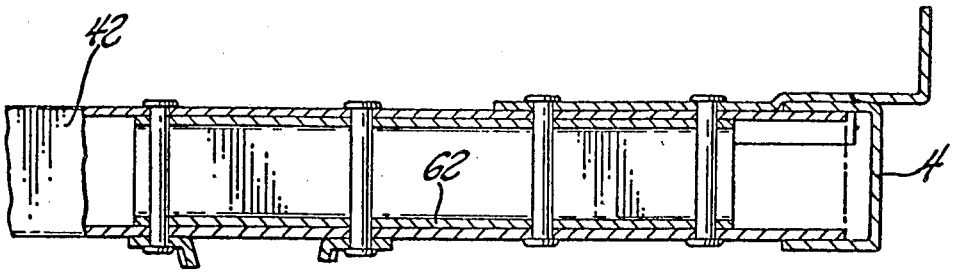
FIG. 2 is a view taken on the line 2—2 of FIG. 1.
Figure 3:
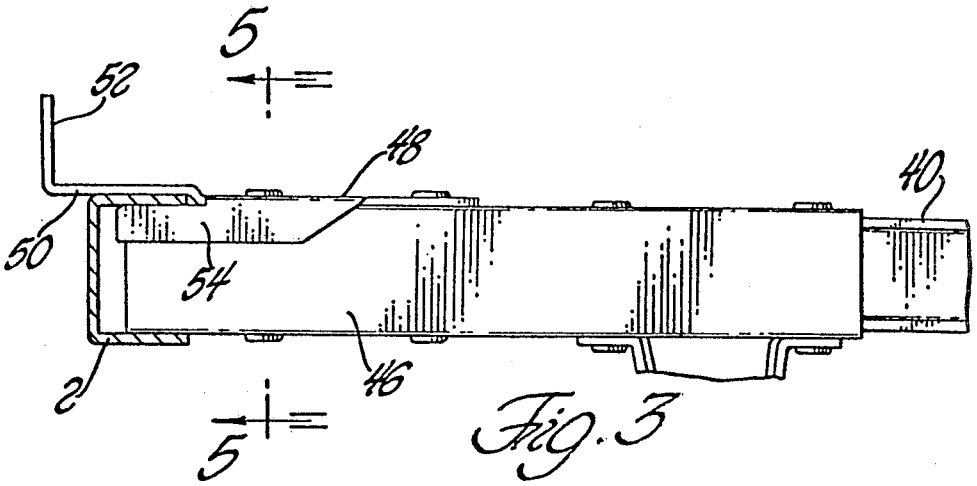
FIG. 3 is a view taken on the line 3—3 of FIG. 1.

To assemble the bed frame to the desired width, the rail members of the end rails are pivoted outwardly from their folded positions and are telescoped together, through the openings in the longitudinal center rail, until the desired width is attained and the appropriate openings 22 in the rail members are aligned with each other and with the openings, like those illustrated at 72 and 74, in the tabs of the longitudinal center rail—during all of which the pins 82 and 84 are in their withdrawn position. Then the pins 82 and 84 are allowed to move to their positions through the aligned openings thereby securing the connections between the end rails and the longitudinal center rail. Likewise, the rail members of the transverse center rail are telescoped together, through the openings 64 in the longitudinal center rail, until the length of the transverse center rail is such as to provide the desired frame width, whereupon the pin 80 is allowed to project, under the bias of spring 78, through the aligned openings 44 in the transverse center rail and the openings 72 and 74. In telescoping the rail members of the transverse center rail together, they are first telescoped together sufficiently to allow the connected engagement of the ends of the transverse center rail with the side rails, whereupon the rail members are telescoped outwardly to form the connections of the transverse center rail with the side rails, as shown in FIGS. 1, 2, and 3.

With the frame thus assembled, as shown in FIG. 1, the bedding, for example a box spring unit (not shown), is placed thereon, the upstanding tabs 52 as well as others such as illustrated at 104, 106, and 108, being provided on the side rails to prevent lateral movement of the bedding with respect to the frame.

It will be understood that while the invention has been described particularly with reference to a preferred embodiment thereof, various changes and modifications may be made all within the full and intended scope of the claims which follow.

What is claimed is:

1. A bed frame comprising two spaced, parallel, longitudinal side rails, two spaced, parallel, transverse end rails extending between and having their ends pivotally connected to said side rails, a longitudinal center rail between and extending parallel to said side rails and having ends disconnectably connected to said end rails, a transverse center rail between and extending parallel to said end rails and having ends disconnectably connected to said side rails and a center portion disconnectably connected to said longitudinal center rail, all of said longitudinal and transverse rails being in substantially the same plane, said transverse center rail and said transverse end rails each including a pair of rail members with center portions which overlap in telescoped relationship and which are adjustably connected together adjacent the connection of the transverse rail to said longitudinal center rail, a support leg secured to and extending downwardly from said frame underneath the connection between said longitudinal and transverse center rails, and a support leg secured to and extending downwardly from said frame adjacent each of the other connections between said longitudinal rails and said transverse rails.

2. A bed frame as set forth in claim 1 wherein said longitudinal center rail has a opening extending therethrough adjacent the center thereof and wherein said transverse center rail extends through said opening.

3. A bed frame as set forth in claim 2 wherein each of said longitudinal side rails has a channel facing toward the interior of the frame and wherein each of the ends of said transverse center rail is shaped and dimensioned to fit into the channel of one of the side rails and has secured thereto a plate with a portion thereof which is spaced from and parallel to the upper surface of the end of the transverse center rail and which lays against the upper surface of the side rail when said transverse center rail is assembled to said side rails thereby to provide the connections therebetween.

4. A bed frame as set forth in claim 3 wherein said plate has downwardly extending flanges at each side thereof with portions having upper edges which fit into the channel of and engage the side rail when the transverse center rail is assembled to the side rails.

* * * * *